US009676591B2

(12) United States Patent
Banno et al.

(10) Patent No.: US 9,676,591 B2
(45) Date of Patent: Jun. 13, 2017

(54) ELEVATOR APPARATUS

(71) Applicant: MITSUBISHI ELECTRIC CORPORATION, Chiyoda-ku (JP)

(72) Inventors: Hirokazu Banno, Chiyoda-ku (JP); Takuo Kugiya, Chiyoda-ku (JP); Yasushi Otsuka, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 0 days.

(21) Appl. No.: 15/023,301

(22) PCT Filed: Sep. 20, 2013

(86) PCT No.: PCT/JP2013/075460
§ 371 (c)(1),
(2) Date: Mar. 18, 2016

(87) PCT Pub. No.: WO2015/040734
PCT Pub. Date: Mar. 26, 2015

(65) Prior Publication Data

US 2016/0214832 A1 Jul. 28, 2016

(51) Int. Cl.
*B66B 5/00* (2006.01)
*B66B 5/06* (2006.01)
*B66B 1/34* (2006.01)

(52) U.S. Cl.
CPC ..... *B66B 5/0031* (2013.01); *B66B 1/3492* (2013.01); *B66B 5/06* (2013.01)

(58) Field of Classification Search
CPC ..... B66B 5/00031; B66B 5/04; B66B 5/06
See application file for complete search history.

(56) References Cited

U.S. PATENT DOCUMENTS 8,167,094 B2 * 5/2012 Ueda ..... B66B 1/32 187/288
8,408,364 B2 * 4/2013 Kangas ..... B66B 1/3492 187/247

(Continued)

FOREIGN PATENT DOCUMENTS

EP 1 864 936 A1 12/2007
EP 2 090 541 A1 8/2009

(Continued)

OTHER PUBLICATIONS

International Search Report issued Dec. 3, 2013 in PCT/JP2013/075460.

*Primary Examiner* — Robert W Horn
(74) *Attorney, Agent, or Firm* — Oblon, McClelland, Maier & Neustadt, L.L.P.

(57) ABSTRACT

In an elevator apparatus, a reference position switch is a usually closed switched that is opened by a car moving to a reference position. A detected body is installed inside a hoistway. A detected body detector that detects the detected body is disposed on the car. A car position detecting portion stores as detected position information of the detected body an amount of movement of the car from where the detected body is detected until the car is detected by the reference position switch by a learning run that is implemented in advance. After completion of the learning run, the car position detecting portion detects the car position based on information from the detected body detector, the stored detected position information, and information from a movement detector that outputs a signal that corresponds to an amount of movement of the car.

9 Claims, 8 Drawing Sheets

(56) References Cited

U.S. PATENT DOCUMENTS

| | | | | |
|---|---|---|---|---|
| 8,430,212 | B2 * | 4/2013 | Ueda | B66B 5/0031 187/247 |
| 9,434,575 | B2 * | 9/2016 | Kattainen | H02P 3/02 |
| 2002/0193963 | A1 * | 12/2002 | Coste | B66B 1/40 702/150 |
| 2015/0183618 | A1 * | 7/2015 | Kondo | B66B 1/468 187/380 |
| 2015/0314987 | A1 * | 11/2015 | Varelius | B66B 1/36 187/334 |
| 2015/0336768 | A1 * | 11/2015 | Otsuka | B66B 1/36 187/394 |
| 2016/0107862 | A1 * | 4/2016 | Kattainen | B66B 5/0031 187/247 |
| 2016/0214832 | A1 * | 7/2016 | Banno | B66B 5/06 |

FOREIGN PATENT DOCUMENTS

| | | | |
|---|---|---|---|
| JP | 64-43481 | A | 2/1989 |
| JP | 5-262473 | A | 10/1993 |
| JP | 9-263373 | A | 10/1997 |
| JP | 11-246141 | A | 9/1999 |
| JP | 2006-273541 | A | 10/2006 |
| JP | 2007-302362 | A | 11/2007 |
| JP | 2013-119467 | A | 6/2013 |
| WO | WO 2006/103768 | A1 | 10/2006 |
| WO | WO 2008/068863 | A1 | 6/2008 |

* cited by examiner

ELEVATOR APPARATUS

TECHNICAL FIELD

The present invention relates to an elevator apparatus in which a detected body, such as an integrated circuit (IC) tag, for example, for detecting a car position is installed in a hoistway.

BACKGROUND ART

In conventional elevator terminal floor forced deceleration apparatuses, a long cam that has a plurality of operating points is installed in a terminal portion of a hoistway. A position detecting switch that is operated by the cam is disposed on a car. The position detecting switch has a plurality of contacts that correspond to the operating points of the cam. An overspeed monitoring level that corresponds to an operating point is set when the operating point is detected by the position detecting switch (see Patent Literature 1, for example).

In conventional elevator controlling apparatuses, a plurality of switches that operate when a car passes by are installed so as to be spaced apart from each other vertically inside a hoistway. A cam that operates the switches is disposed on the car (see Patent Literature 2, for example).

In addition, in conventional elevator car position detecting systems, a plurality of integrated circuit (IC) tags that transmit specific information are installed inside a hoistway. A receiver that acquires the specific information of the IC tags without contacting the IC tags is mounted to a car. A position estimating means estimates car position using the specific information that is acquired by the receiver and other position information that relates to the amount of movement or position of the car (see Patent Literature 3, for example).

CITATION LIST

Patent Literature

[Patent Literature 1]
Japanese Patent Laid-Open No. HEI 11-246141 (Gazette)
[Patent Literature 2]
Japanese Patent Laid-Open No. SHO 64-43481 (Gazette)
[Patent Literature 3]
Japanese Patent Laid-Open No. 2006-273541 (Gazette)

SUMMARY OF THE INVENTION

Problem to be Solved by the Invention

In the conventional terminal floor forced deceleration apparatus that is disclosed in Patent Literature 1, manufacturing costs are increased because it is necessary to manufacture the long cam to a high precision. Installation work is also time-consuming because it is necessary to install the cam in a precise position.

In the conventional elevator controlling apparatus that is disclosed in Patent Literature 2, although manufacturing of a long cam is not required, if applied to an elevator in which a car travels at high speed, then because noise due to the cam colliding with the switches is increased, high costs are required for countermeasures. Countermeasures are also required against switch failure due to mechanical shock from the collisions.

In addition, in the conventional car position detecting system that is disclosed in Patent Literature 3, manufacturing of a long cam is not required, and problems with collision noise do not arise. However, if a terminal floor position is detected erroneously when distances from a terminal floor, which is a reference position, to the IC tags are being preprogrammed into the position estimating means, then the distances from the terminal floor to the IC tags may also be stored erroneously. Because of that, there is a risk that the distance from the car to the terminal floor may be determined to be larger than it actually is when the car is subsequently running, and approach of the car to the terminal floor may be detected too late, requiring high costs for countermeasures for preventing the same.

The present invention aims to solve the above problems and an object of the present invention is to provide an elevator apparatus that can detect car position and that can that improve reliability of car position detection by a simple configuration.

Means for Solving the Problem

An elevator apparatus according to the present invention includes: a car that is raised and lowered inside a hoistway; a reference position switch that detects that the car is positioned at a reference position in a vicinity of a terminus of the hoistway; at least one detected body that is installed inside the hoistway; a detected body detector that is disposed on the car, and that detects the detected body when the car passes a position of installation of the detected body; a movement detector that outputs a signal that corresponds to an amount of movement of the car; and a car position detecting portion that detects a position of the car inside the hoistway, wherein: the reference position switch is a usually closed switch that is opened by the car moving to the reference position; and the car position detecting portion stores as detected position information for the detected body an amount of movement of the car from where the detected body is detected by the detected body detector until the car is detected by the reference position switch by a learning run that is implemented in advance, and after completion of the learning run, detects the position of the car based on information from the detected body detector, the stored detected position information, and information from the movement detector.

Effects of the Invention

In an elevator apparatus according to the present invention, because a usually closed switch that is opened by the car moving to the reference position in the vicinity of the terminus of the hoistway is used as a reference position switch, and the car position detecting portion stores as detected position information for the detected body an amount of movement of the car from when the detected body is detected by the detected body detector until the car is detected by the reference position switch by a learning run that is implemented in advance, car position can be detected by a simple configuration, enabling reliability of car position detection to be improved.

DESCRIPTION OF EMBODIMENTS

Embodiments for implementing the present invention will now be explained with reference to the drawings.

Embodiment 1

Figure 1:
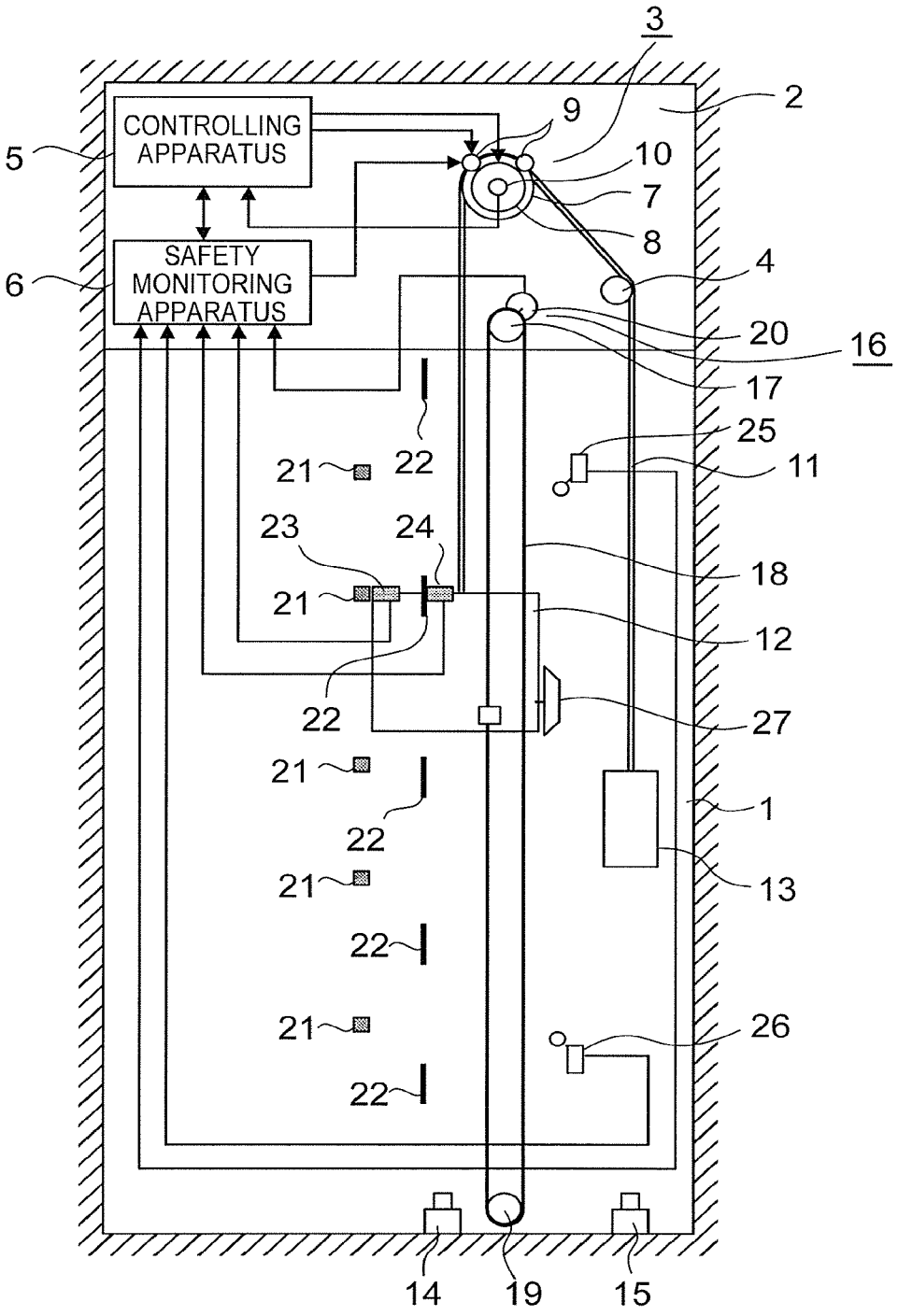
FIG. 1 is a configuration diagram that shows an elevator apparatus according to Embodiment 1 of the present invention.

FIG. 1 is a configuration diagram that shows an elevator apparatus according to Embodiment 1 of the present invention. In the figure, a machine room 2 is disposed in an upper portion of a hoistway 1. A hoisting machine (a driving apparatus) 3, a deflecting sheave 4, a controlling apparatus 5, and a safety monitoring apparatus 6 are installed in the machine room 2.

The hoisting machine 3 has: a driving sheave 7; a hoisting machine motor 8 that generates a driving torque that rotates the driving sheave 7; a plurality of hoisting machine brakes 9 that generate a braking torque that brakes rotation of the driving sheave 7; and a hoisting machine encoder 10 that generates a signal that corresponds to the rotation of the driving sheave 7.

A suspending body 11 is wound around the driving sheave 7 and the deflecting sheave 4. A plurality of ropes or a plurality of belts are used as the suspending body 11. A car 12 is connected to a first end portion of the suspending body 11. A counterweight 13 is connected to a second end portion of the suspending body 11.

The car 12 and the counterweight 13 are suspended inside the hoistway 1 by the suspending body 11, and are raised and lowered inside the hoistway 1 by the hoisting machine 3. The signal from the hoisting machine encoder 10 is inputted into the controlling apparatus 5. The controlling apparatus 5 raises and lowers the car 12 at a set velocity by controlling rotation of the hoisting machine 3. In other words, operation of the hoisting machine motor 8 and operation of the hoisting machine brakes 9 are controlled by the controlling apparatus 5.

A pair of car guide rails (not shown) that guide raising and lowering of the car 12 and a pair of counterweight guide rails (not shown) that guide raising and lowering of the counterweight 13 are installed inside the hoistway 1. A car buffer 14 and a counterweight buffer 15 are installed on a bottom portion of the hoistway 1.

A speed governor 16 is disposed in the machine room 2. The speed governor 16 has a speed governor sheave 17. A speed governor rope 18 is wound around the speed governor sheave 17. The speed governor rope 18 is installed in a loop inside the hoistway 1, and is connected to the car 12. The speed governor rope 18 is wound around a tensioning sheave 19 that is disposed in a lower portion of the hoistway 1.

The speed governor rope 18 is moved cyclically when the car 12 is raised and lowered to rotate the speed governor sheave 17 at a rotational velocity that corresponds to the traveling velocity of the car 12. A speed governor encoder 20 that generates a signal that corresponds to rotation of the speed governor sheave 17 is disposed on the speed governor 16. The speed governor encoder 20 is disposed so as to be coaxial with an axis of rotation of the speed governor sheave 17. The speed governor encoder 20 is a movement detector that outputs a signal that corresponds to an amount of movement of the car 12.

A plurality of detected bodies for detecting the position of the car 12 are installed inside the hoistway 1. The detected bodies according to Embodiment 1 include: a plurality of integrated circuit (IC) tags that constitute storage media in which specific identification (ID) information (identifying information) is stored; and a plurality of floor position plates 22 that indicate floor alignment positions of the car 12.

The IC tags 21 are installed at identical positions inside the hoistway 1 when viewed from directly above so as to be spaced apart from each other vertically. The floor position plates 22 are installed at identical positions inside the hoistway 1 (positions that are different than those of the IC tags 21) when viewed from directly above so as to be spaced apart from each other vertically.

Detected body detectors that detect the detected bodies when the car 12 passes the positions of installation of the detected bodies are disposed on the car 12. The detected body detectors according to Embodiment 1 include: an IC tag reader 23 that reads the ID information from the IC tags 21; and a floor sensor 24 that detects the floor position plates 22.

The IC tag reader 23 is installed on a side surface of the car 12. The IC tag reader 23 acquires the ID information that is embedded in the IC tags 21 without contact when in close proximity to the IC tags 21. The detecting region can be limited narrowly by using short-range wireless IC tags 21 and an IC tag reader 23, that use an electromagnetic field or electromagnetic waves such as radio frequency identification (RFID), for example.

Facilitation of maintenance and wire saving inside the hoistway 1 can also be achieved by using passive IC tags 21 that operate by using electromagnetic waves from the IC tag reader 23 as an energy source.

The floor sensor 24 is installed on a side surface of the car 12. The floor sensor 24 is a sensor that detects an edge of the floor position plates 22 without contact, and an optical sensor or a magnetic sensor can be used therefor, for example.

The floor position plates 22 are installed so as to correspond to all of the floors, and are disposed so as to be in close proximity to the floor sensor 24 when the car 12 is positioned within a range in which the door can be opened safely. Although not shown in FIG. 1, the floor sensor 24 is connected to the controlling apparatus 5. The controlling apparatus 5 determines whether or not to implement opening of the door of the car 12 based on the signal from the floor sensor 24, and implements control of door opening.

An uppermost floor switch 25 that functions as a reference position switch (an upper portion reference position switch) is disposed in an upper portion inside the hoistway 1. A lowermost floor switch 26 that functions as a reference position switch (a lower portion reference position switch) is disposed in a lower portion inside the hoistway 1. A switching rail 27 that functions as a switch operating member that directly operates the uppermost floor switch 25 and the lowermost floor switch 26 is disposed on the car 12.

The switching rail 27 comes into contact with the uppermost floor switch 25 when the car 12 is stopped at, or immediately before stopping at, a reference position in a vicinity of an upper terminus of the hoistway 1, in this case the uppermost floor (an upper terminal floor) to open the circuit of the uppermost floor switch 25. The uppermost floor switch 25 and the switching rail 27 are disposed such that the open state of the uppermost floor switch 25 is maintained while the car 12 is stopped at the uppermost floor.

In addition, the switching rail 27 comes into contact with the lowermost floor switch 26 when the car 12 is stopped at, or immediately before stopping at, a reference position in a vicinity of a lower terminus of the hoistway 1, in this case the lowermost floor (a lower terminal floor) to open the circuit of the lowermost floor switch 26. Furthermore, the lowermost floor switch 26 and the switching rail 27 are disposed such that the open state of the lowermost floor switch 26 is maintained while the car 12 is stopped at the lowermost floor.

The uppermost floor switch 25 is a usually closed switch that is opened by the car 12 moving to the uppermost floor. The lowermost floor switch 26 is a usually closed switch that is opened by the car 12 moving to the lowermost floor.

The uppermost floor switch 25 and the lowermost floor switch 26 are switches that have a construction of limit switch (a contact forced-separation mechanism) in which an elastic body is not interposed between the point of contact with the switching rail 27 and the circuit contact.

The speed governor encoder 20, the IC tag reader 23, the floor sensor 24, the uppermost floor switch 25, and the lowermost floor switch 26 are connected to the safety monitoring apparatus 6 by means of wiring. Signals from the speed governor encoder 20, the IC tag reader 23, the floor sensor 24, the uppermost floor switch 25, and the lowermost floor switch 26 are thereby respectively inputted into the safety monitoring apparatus 6.

The safety monitoring apparatus 6 monitors for the presence or absence of overspeed traveling of the car 12. The safety monitoring apparatus 6 is connected to the hoisting machine brakes 9 by means of wiring, and if overspeed traveling is detected, outputs a command for activating the hoisting machine brakes 9 to stop the car 12. In addition, transmission of signals by communication is possible between the safety monitoring apparatus 6 and the controlling apparatus 5.

Next, details of functioning of the safety monitoring apparatus 6 will be explained. An overspeed travel monitoring reference such as that shown in FIG. 2, i.e., an overspeed monitoring level (a velocity monitoring pattern) V1, is set in the safety monitoring apparatus 6. The overspeed monitoring level V1 is derived by computation by the safety monitoring apparatus 6. The overspeed monitoring level V1 is set so as to be higher than the locus of the target velocity V0 (a normal traveling pattern) when the car 12 is traveling at a rated velocity and stops at a terminal floor alignment position P0 (an uppermost floor alignment position or a lowermost floor alignment position).

In addition, the overspeed monitoring level V1 is set so as to become lower toward the terminal floor alignment position P0 in the vicinity of the terminal floor. The safety monitoring apparatus 6 detects overspeed traveling of the car 12 by comparing the velocity of the car 12 with the overspeed monitoring level V1. In other words, the safety monitoring apparatus 6 determines that overspeed traveling has occurred if the velocity of the car 12 becomes greater than or equal to the overspeed monitoring level V1.

The overspeed monitoring level V1 is expressed as a function of the distance from the terminal floor to the car 12. Overspeed traveling of the car 12 toward the terminal floor is thereby detected early, enabling the velocity of the car 12 to be kept low approaching the terminal floor. As a result, the buffers 14 and 15 can be downsized, enabling the hoistway 1 to be reduced, and the roof occupying region of the elevator apparatus can also be reduced.

The safety monitoring apparatus 6 detects the position of the car 12, and derives the overspeed monitoring level V1. In other words, the safety monitoring apparatus 6 has a function as a car position detecting portion. The safety monitoring apparatus 6 uses the signals from the speed governor encoder 20, the IC tag reader 23, the floor sensor 24, the uppermost floor switch 25, and the lowermost floor switch 26 to detect the position of the car 12.

The specific method for detecting the position of the car 12 using the safety monitoring apparatus 6 will now be explained. The controlling apparatus 5 and the safety monitoring apparatus 6 implement a learning run before this elevator apparatus commences service. In the learning run, the car 12 is moved, and the amount of movement of the car 12 after a floor position plate 22 is detected by the floor sensor 24 until the car 12 is detected by the uppermost floor switch 25 or the lowermost floor switch 26 is stored as the detected position information for the floor position plate 22.

The safety monitoring apparatus 6 stores the detected position information of the floor position plates 22 and the ID information of the IC tags 21 in relation to each other. The safety monitoring apparatus 6 stores the number of floor position plates 22 detected after the position where the floor position plates 22 are detected by the floor sensor 24 until the car 12 is detected by the uppermost floor switch 25 or the lowermost floor switch 26 in relation to the detected position information for the floor position plates 22.

After this elevator apparatus commences service, the safety monitoring apparatus 6 detects the position of the car 12 based on the information from the floor sensor 24, the stored detected position information for the floor position plates 22, and the information from the speed governor encoder 20.

The safety monitoring apparatus 6 uses the signal from the speed governor encoder 20 to detect the direction in which the car 12 is traveling. In addition, each time the safety monitoring apparatus 6 detects that the floor sensor 24 has detected a floor position plate 22, the direction of travel of the car 12 that is detected using the signal from the speed governor encoder 20 is used to compute what number floor position plate 22 the detected floor position plate 22 is from the uppermost floor switch 25 or the lowermost floor switch 26. The safety monitoring apparatus 6 identifies the detected floor position plate 22 thereby.

Because the distance from each of the floor position plates 22 to the uppermost floor switch 25 and the distance to the lowermost floor switch 26 are stored in advance, the safety monitoring apparatus 6 can detect the position of the car 12 by the detected floor position plate 22, and it can also detect if the car 12 has approached a terminal floor.

The safety monitoring apparatus 6 interpolates position information for the car 12 between each of the floor position plates 22 by applying computational processing to the signal from the speed governor encoder 20. Specifically, the safety monitoring apparatus 6 integrates the output pulse of the speed governor encoder 20 per unit time, and interpolates using an amount of displacement of the car 12 that is found by multiplying that integrated value by a coefficient that allows for outside diameters of the speed governor sheave 17 and the speed governor rope 18, and a pulse count per period of the speed governor encoder 20.

Thus, the safety monitoring apparatus 6 continuously detects the position of the car 12 when it is between the operating positions of the uppermost floor switch 25 and the lowermost floor switch 26, and calculates an overspeed monitoring level V1 that corresponds to the detected position of the car 12.

The controlling apparatus 5 and the safety monitoring apparatus 6 can each be constituted by an independent computer.

Next, a method for detecting the velocity of the car 12 using the safety monitoring apparatus 6 will be explained in detail. The safety monitoring apparatus 6 integrates the output pulse of the speed governor encoder 20 per unit time. An amount of displacement of the car 12 per unit time is found by multiplying that integrated value by a coefficient that allows for outside diameters of the speed governor sheave 17 and the speed governor rope 18, and a pulse count per period of the speed governor encoder 20. The velocity of the car 12 is calculated by dividing the found amount of displacement by the unit time.

The safety monitoring apparatus 6 compares the velocity of the car 12 and the calculated overspeed monitoring level V1, and if it detects that the velocity of the car 12 is higher than the overspeed monitoring level V1, outputs a command that activates the hoisting machine brakes 9.

A premise of the computational processing by the safety monitoring apparatus 6 that has been described thus far is that the position of the car 12 is detected continuously. However, the safety monitoring apparatus 6 continues overspeed travel monitoring of the car 12 even if the position of the car 12 cannot be detected, and performs computational processing for detecting the position of the car 12.

Overspeed travel monitoring by the safety monitoring apparatus 6 when the position of the car 12 cannot be detected will first be explained. In the elevator apparatus according to Embodiment 1, the car 12 may still move while an electric power supply is interrupted due to a power outage or to an intentional power shutdown.

Because the movement of the car 12 cannot be detected when the electric power supply is not being supplied, an erroneous overspeed monitoring level V1 would be set by the safety monitoring apparatus 6 if the position information of the car 12 from immediately before the electric power outage were to continue to be used on resumption of the power supply.

Thus, during a power shutdown, the safety monitoring apparatus 6 assumes that there is no step to save the position information of the car 12 that has been detected until then. Overspeed travel monitoring that does not depend on position information is performed immediately after a power-up.

Figure 2:
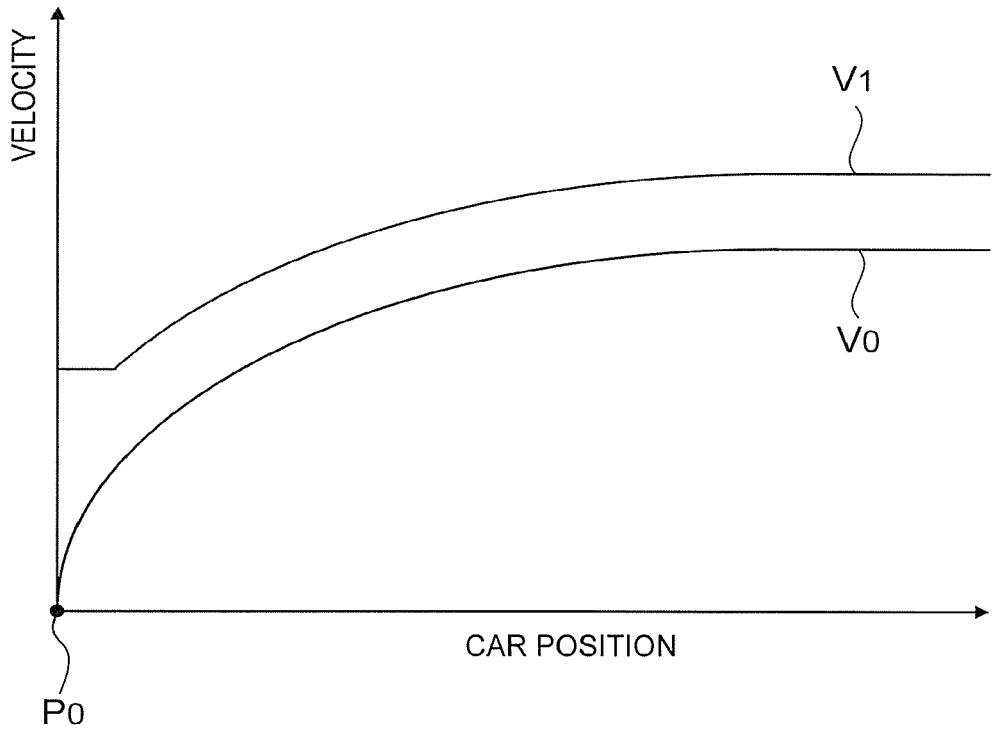
FIG. 2 is a graph that shows overspeed travel monitoring references that are set in a safety monitoring apparatus from FIG. 1.

Specifically, overspeed travel monitoring that uses a constant reference that does not depend on the position of the car 12 is performed instead of overspeed travel monitoring that is based on a pattern that changes depending on the position of the car 12 such as that shown in FIG. 2. Hereafter, the constant overspeed travel monitoring reference that does not depend on the position of the car 12 will be called a "constant velocity monitoring level" (an auxiliary monitoring level).

A minimum value of the overspeed monitoring level V1 that is shown in FIG. 2, or a value that is lower than that, is set as the constant velocity monitoring level. The velocity of the car 12 when approaching a terminal floor can thereby be kept to less than or equal to that of overspeed travel monitoring that is based on the overspeed monitoring level V1.

Next, a position detecting method for the car 12 by the safety monitoring apparatus 6 when the position of the car 12 cannot be detected will be explained. Moreover, the behavior of the controlling apparatus 5 is also related to this position detecting method.

First, if it is detected immediately after power-up that the position of the car 12 cannot be ascertained, the safety monitoring apparatus 6 commences overspeed travel monitoring that uses constant velocity monitoring level, and simultaneously transmits the state of the safety monitoring apparatus 6 to the controlling apparatus 5. Here, the state of the safety monitoring apparatus 6 that is transmitted to the controlling apparatus 5 indicates that the position information of the car 12 cannot be ascertained.

If the controlling apparatus 5 ascertains that the safety monitoring apparatus 6 in a state in which the car position cannot be detected, then service is recommenced so as to limit a maximum value of the traveling velocity of the car 12 to a value that is lower than the constant velocity monitoring level. If the car 12 continues traveling in this state, it will eventually pass the position of installation of an IC tag 21.

The safety monitoring apparatus 6 has stored the distance from the position of the car 12 when the IC tag reader 23 detects the ID information that is embedded in the IC tag 21 to the position of the car 12 when the uppermost floor switch 25 is opened by coming into contact with the switching rail 27 during the learning run.

The safety monitoring apparatus 6 has also stored the distance from the position of the car 12 when the IC tag reader 23 detects the ID information that is embedded in the IC tag 21 to the position of the car when the lowermost floor switch 26 is opened by coming into contact with the switching rail 27 during the learning run.

If ID information that is embedded in an IC tag 21 is detected during overspeed travel monitoring that uses the constant velocity monitoring level, then the safety monitoring apparatus 6 determines which is the closest floor position plate in the direction of travel of the car 12. Furthermore, when the floor sensor 24 detects a floor position plate 22 as the car 12 moves, the position of the car 12 is determined based on the positions of the floor position plates 22 detected while learning.

Here, the reason that car position is not determined using only the signal from the IC tag reader 23 is because it is difficult to limit the region in which the IC tag reader 23 can detect the ID information narrowly, making the precision of the detected position problematic.

Once the safety monitoring apparatus 6 has determined the position of the car 12, the overspeed travel monitoring reference is changed from the constant velocity monitoring level to the overspeed monitoring level V1, and overspeed travel monitoring is continued. The safety monitoring apparatus 6 simultaneously stops transmitting the signal to the controlling apparatus 5 that indicates that the position information of the car 12 cannot be ascertained. The controlling apparatus 5 thereby releases the above-mentioned velocity limitation, and recommences service in which the velocity is raised to the rated velocity.

Next, details of the learning run will be explained. In the learning run, the safety monitoring apparatus 6 detects and stores the position of the car 12 when the floor sensor 24 detects each of the floor position plates 22, and the distance from the position of the car 12 when the IC tag reader 23 detects the ID information that is embedded in the IC tags 21 to the position of the car 12 when the uppermost floor switch 25 and the lowermost floor switch 26 are opened by coming into contact with the switching rail 27.

The safety monitoring apparatus 6 commences overspeed travel monitoring that uses constant velocity monitoring level if the detected position of at least one of the floor position plates 22 and the IC tags 21 has not been detected, or if there has been a request to implement learning due to operation by a maintenance worker or an installation worker. The safety monitoring apparatus 6 simultaneously transmits to the controlling apparatus 5 a signal that indicates that it is in a state in which learning has not been completed or is in a state in which it has been requested to implement learning.

Thus, the controlling apparatus 5 limits the maximum value of the traveling velocity of the car 12 to a lower value than the constant velocity monitoring level, moves the car 12 to the lowermost floor, and transmits a command by means of communication to the safety monitoring apparatus 6 to commence learning. In order to implement accurate learning, the controlling apparatus 5 subsequently moves the car 12 to the uppermost floor at a sufficiently low velocity, and stops the car 12 at the uppermost floor. Next, the controlling apparatus 5 moves the car 12 to the lowermost floor at a sufficiently low velocity, and stops the car 12 at the lowermost floor.

At the same time, the safety monitoring apparatus 6, which has received the command to commence learning from the controlling apparatus 5, initializes the position information for the car 12, and commences measurement of the distance moved by the car 12 using the speed governor encoder 20 during ascent. When a floor position plate 22 is detected during the ascent of the car 12, the number of times floor position plates 22 have been detected since commencement of ascent and the distance moved by the car 12 during detection are stored.

When an IC tag 21 is detected, the detected ID information and the distance moved by the car 12 during detection are stored. Then, when opening of the uppermost floor switch 25 is detected, the distance moved by the car 12 during detection is stored as a total ascent distance.

When the safety monitoring apparatus 6 detects that the car 12 has stopped by the signal from the speed governor encoder 20, then the distance moved by the car 12 is initialized, and measurement of the distance moved by the car 12 during descent is commenced. When a floor position plate 22 is detected during the descent of the car 12, the number of times floor position plates 22 have been detected since commencement of descent and the distance moved by the car 12 during detection are stored.

When an IC tag 21 is detected, the detected ID information and the distance moved by the car 12 during detection are stored. Then, when opening of the lowermost floor switch 26 is detected, the distance moved by the car 12 during detection is stored as a total descent distance.

Next, the distance moved from each of the floor position plates 22 and each of the IC tags 21 to the detected position of the uppermost floor switch 25 is calculated by subtracting from the total ascent distance the distance moved by the car 12 at the time of detection of each of the floor position plates 22 and the distance moved at the time of detection of each of the IC tags 21 that were stored during ascent. Then, the safety monitoring apparatus 6 stores the number of the detected position of each of the floor position plates 22 to the uppermost floor switch 25 and the position information that corresponds thereto. The position information that corresponds to the ID information of each of the IC tags 21 is also stored.

The distance moved from each of the floor position plates 22 and each of the IC tags 21 to the detected position of the lowermost floor switch 26 is similarly calculated by subtracting from the total descent distance the distance moved by the car 12 at the time of detection of each of the floor position plates 22 and the distance moved at the time of detection of each of the IC tags 21 that were stored during descent. Then, the safety monitoring apparatus 6 stores the number of the detected position of each of the floor position plates 22 to the lowermost floor switch 26 and the position information that corresponds thereto. The position information that corresponds to the ID information of each of the IC tags 21 is also stored.

Next, the safety monitoring apparatus 6 checks the rationality of each of the values that were stored during ascent and each of the values that were stored during descent. It is determined that these are not rational if there is a large difference between the spacing of each of the floor position plates 22 that is detected on the ascending run and the spacing of each of the floor position plates that is detected on the descending run, if there is a difference between the number detected, if the order of the detected ID information is different, or if there is a large difference between the total ascent distance and the total descent distance, for example.

If it is determined that the learning results are not rational, the safety monitoring apparatus 6 will issue a learning run implementation request to the controlling apparatus 5. If, on the other hand, it is determined that rational learning results have been obtained, the safety monitoring apparatus 6 transmits to the controlling apparatus 5 that learning has been completed. The overspeed travel monitoring reference is changed from the constant velocity monitoring level to the overspeed monitoring level V1, and overspeed travel monitoring is continued.

When a learning completion signal is received from the safety monitoring apparatus 6, the controlling apparatus 5 releases the above-mentioned velocity limitation, and commences service in which the velocity is raised to the rated velocity.

Now, in the elevator apparatus according to Embodiment 1, because switches that have a construction of limit switch are adopted as the uppermost floor switch 25 and the lowermost floor switch 26, even if a contact portion were to become attached, the contact portion would be pulled off forcibly and opened when the switching rail 27 comes into contact. Because of that, it is not necessary to anticipate failures such as becoming unable to detect that the car 12 is positioned in the operating positions of the uppermost floor switch 25 and the lowermost floor switch 26.

Because the detected positions of each of the floor position plates 22 and each of the IC tags 21 are learned as distances to the operating points of the uppermost floor switch 25 and the lowermost floor switch 26, in the rare event that the uppermost floor switch 25 or the lowermost floor switch 26 is opened before the switching rail 27 came into contact during the learning run, the safety monitoring apparatus 6 will determine that the car 12 has reached the terminal floor when the switch is opened. In that case, the safety monitoring apparatus 6 will learn the detected positions of each of the floor position plates 22 and each of the IC tags 21 as being closer to the termini than the usual positions.

If the overspeed monitoring level V1 is set in that state, a pattern is set that is closer to an intermediate floor than the position of the usual pattern. If, for example, the uppermost floor switch 25 is opened during the learning run when the car 12 has arrived at a position one meter shorter than usual, then the overspeed monitoring level V1 in the upward direction will be set closer to the intermediate floor by one meter, and overspeed traveling of the car 12 will be detected earlier than usual.

On the other hand, because it is not necessary to anticipate failures such as the uppermost floor switch 25 and the lowermost floor switch 26 being opened after the switching rail 27 comes into contact, situations such as the overspeed monitoring level V1 being set closer to the termini due to failure of the uppermost floor switch 25 or the lowermost floor switch 26, and overspeed travel detection being delayed thereby cannot occur.

Figure 3:
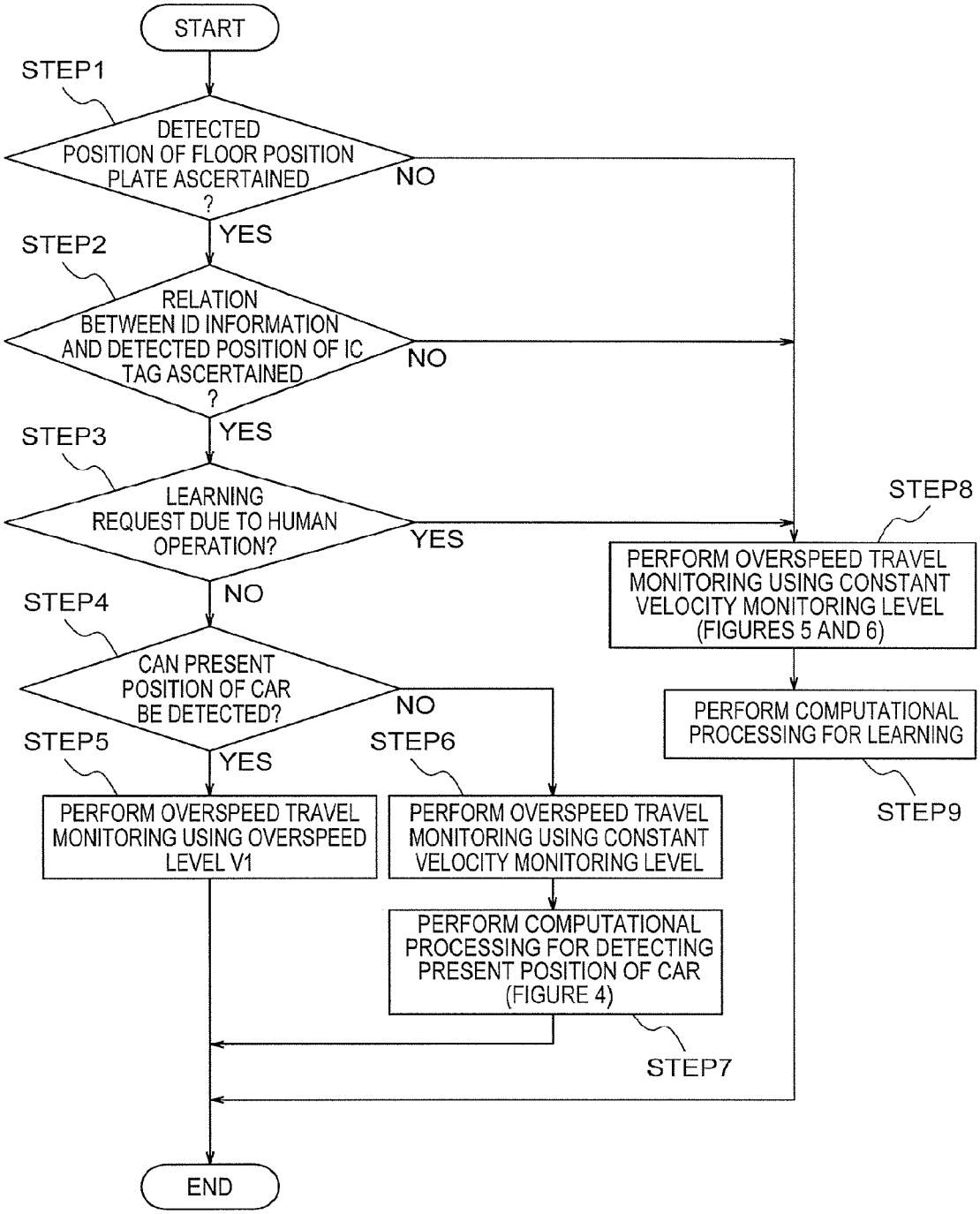
FIG. 3 is a flowchart that shows operation of the safety monitoring apparatus from FIG. 1.

Next, computational processing by the safety monitoring apparatus 6 will be explained using the flowchart in FIG. 3. The safety monitoring apparatus 6 repeatedly executes the computational processing periodically from "START" to "END" as shown in FIG. 3. The safety monitoring apparatus 6 first checks whether learning of the detected positions of the floor position plates 22 and of the detected positions of the ID information of the IC tags 21 has been completed (STEPS 1 and 2).

If learning has been completed, it is checked whether or not there is a learning request due to human operation (STEP 3). If there is no learning request, it is checked whether or not the present position of the car 12 can be detected (STEP 4). If the position of the car 12 can be detected, overspeed travel monitoring that uses an overspeed monitoring level V1 is commenced or continued (STEP 5), and this computational period is set to "END" then returns to "START".

If, on the other hand, the position of the car 12 cannot be detected, overspeed travel monitoring that uses a constant velocity monitoring level is commenced or continued (STEP 6). Then, computational processing for detecting the present position of the car 12 is performed (STEP 7), and this computational period is set to "END" then returns to "START". Moreover, details of the computational processing in STEP 7 will be described below.

If learning has not been completed and there is a human learning request, then overspeed travel monitoring that uses a constant velocity monitoring level is commenced or continued (STEP 8). Then, computational processing is performed for learning (STEP 9), and this computational period is set to "END" then returns to "START". Moreover, details of the computational processing in STEP 9 will also be described below.

Figure 4:
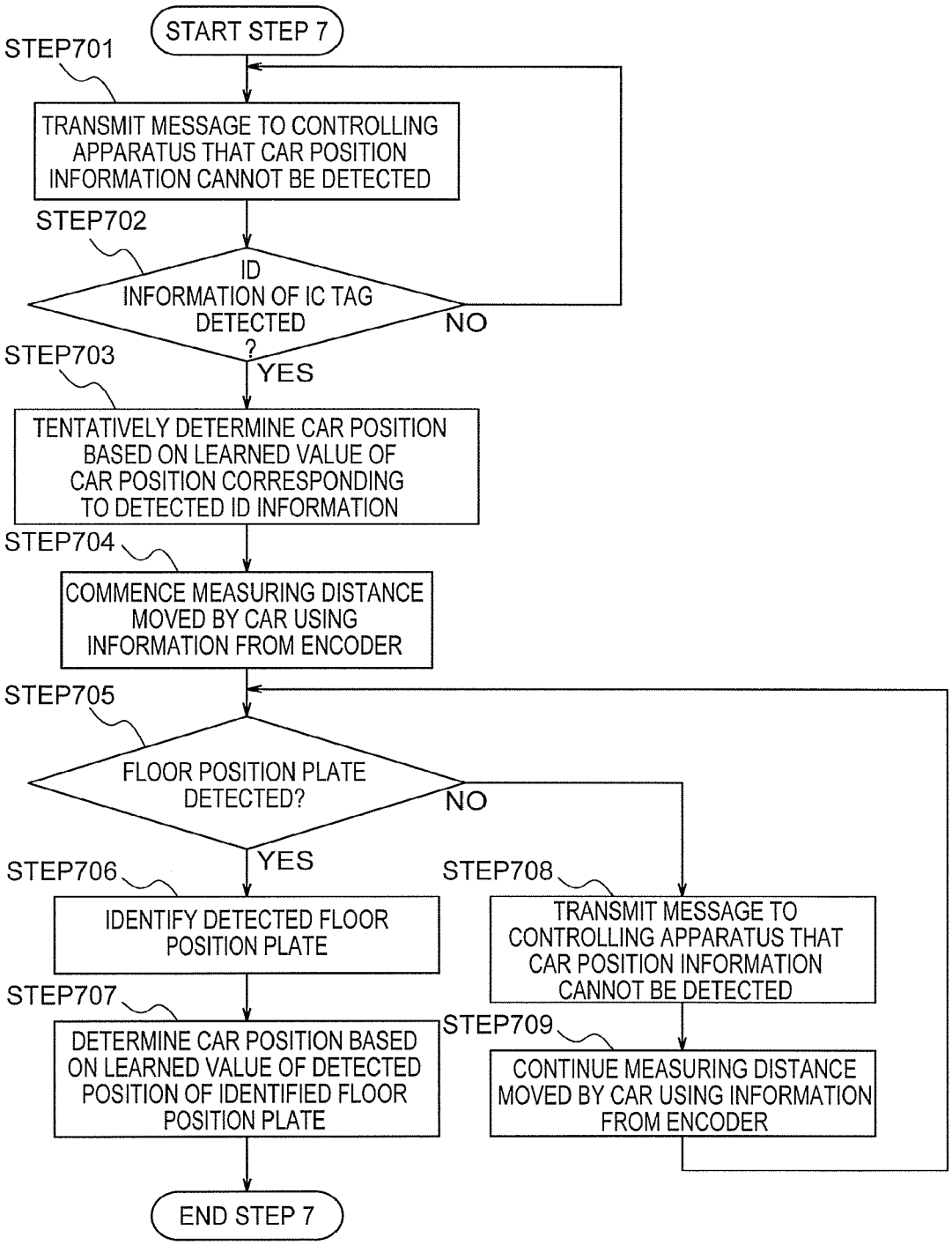
FIG. 4 is a flowchart that shows detailed operation of STEP 7 in FIG. 3.

Next, the computational processing for detecting the present position of the car 12 in STEP 7 in FIG. 3 will be explained using FIG. 4. If the computational processing of STEP 7 is commenced, then the safety monitoring apparatus 6 first transmits to the controlling apparatus 5 that the present position of the car 12 cannot be detected (STEP 701). When the controlling apparatus 5 ascertains that the safety monitoring apparatus 6 cannot detect the present position of the car 12, a maximum value of the traveling velocity of the car 12 is limited to a value that is lower than the constant velocity monitoring level.

Next, the safety monitoring apparatus 6 stands by until the ID information of an IC tag 21 is detected (STEP 702). Until the ID information is detected, it continues to transmit to the controlling apparatus 5 repeatedly that the present position of the car 12 cannot be detected.

If the ID information of an IC tag 21 is detected, on the other hand, the present position of the car 12 is determined tentatively based on the detected ID information from relationships between ID information and detected positions previously learned (STEP 703). Here, the reason that the determination is tentative is that the precision of the learned detected positions of the IC tags 21 cannot be considered to be high because the region of detection of the IC tags 21 by the IC tag reader 23 is wide.

After determining the present position of the car 12 tentatively, measurement of the distance moved by the car 12 is commenced from the point at which the ID information of the IC tag 21 was detected based on the information from the speed governor encoder 20 (STEP 704). Then it is checked whether or not a floor position plate 22 has been detected (STEP 705).

If a floor position plate 22 has not been detected, then it is transmitted to the controlling apparatus 5 that the current position information for the car 12 cannot be detected (STEP 708), and then measurement of the distance moved by the car 12 using the speed governor encoder 20 is continued (STEP 709), while returning to STEP 705. In other words, the computational processing of STEP 708 and STEP 709 is repeated until a floor position plate 22 is detected.

If a floor position plate 22 is detected, then the position of the car 12 at the time of detection of the floor position plate 22 is estimated using the position that was determined tentatively at STEP 703 and the results of the measurements of the distance moved by the car 12 that have been continued in STEP 704 and STEP 709. Then, the floor position plate 22 is identified from a relationship between the estimated position of the car 12 and the detected positions of the floor position plates 22 previously learned (STEP 706).

Then, the present position of the car 12 is determined based on the learned value of the detected position of the identified floor position plate 22 (STEP 707), and the computational processing of STEP 7 is terminated.

Figure 5:
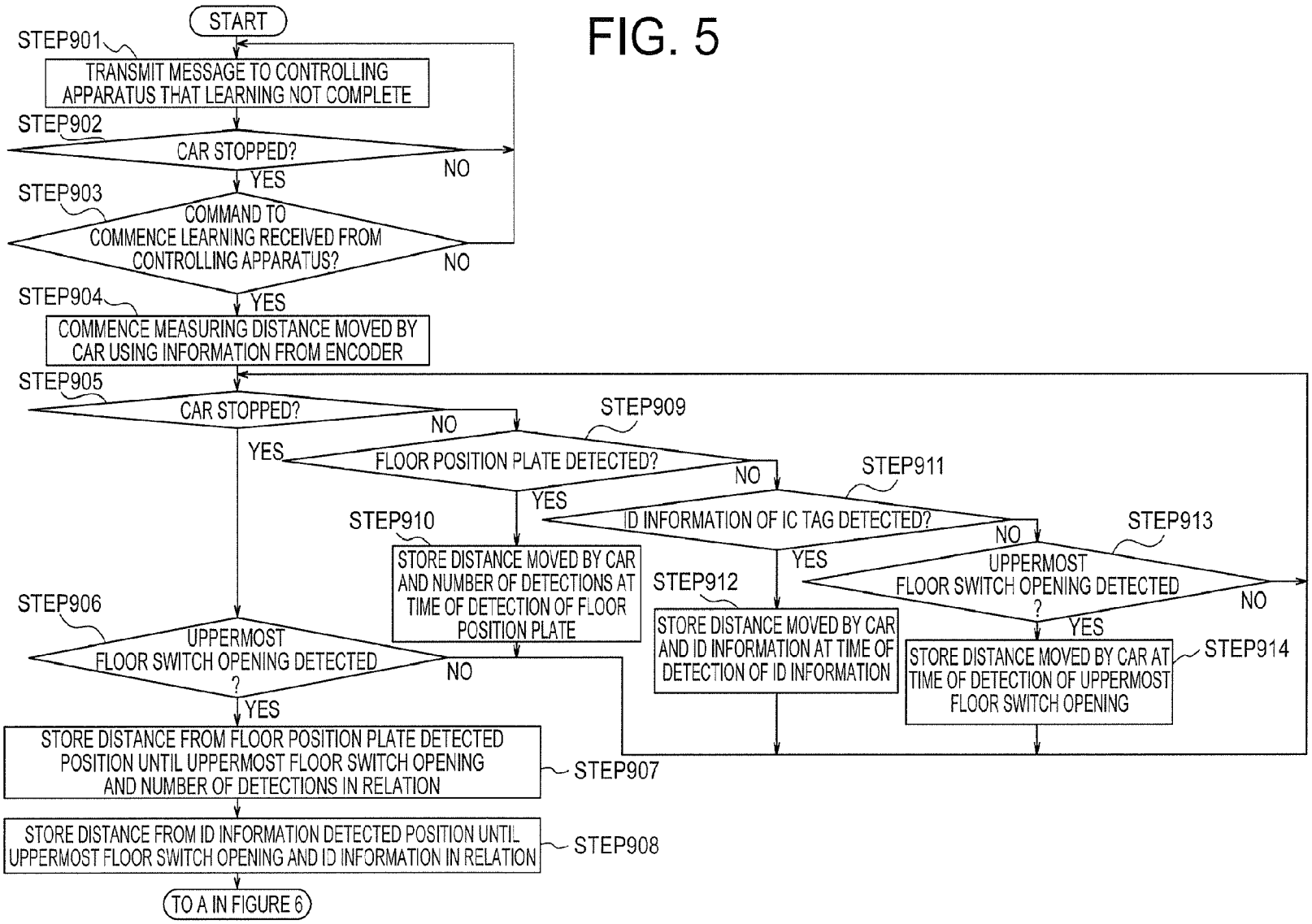
FIG. 5 is a flowchart that shows a first half of detailed operation of STEP 9 in FIG. 3.

Next, the computational processing for learning in STEP 709 in FIG. 3 will be explained using FIGS. 5 and 6. FIG. 5 is a flowchart that shows a first half of detailed operation of STEP 9 in FIG. 3. If the computational processing of STEP 9 is commenced, then the safety monitoring apparatus 6 first transmits to the controlling apparatus 5 that learning has not been completed (STEP 901).

When the controlling apparatus 5 ascertains that learning has not been completed, a maximum value of the traveling velocity of the car 12 is limited to a value that is lower than the constant velocity monitoring level. The controlling apparatus 5 moves the car 12 to the lowermost floor, and transmits a command to the safety monitoring apparatus 6 to commence learning. The controlling apparatus 5 subsequently moves the car 12 to the uppermost floor at a sufficiently low velocity.

The safety monitoring apparatus 6 checks whether the car 12 has stopped (STEP 902), and also checks whether a command to commence learning has been received from the controlling apparatus 5 (STEP 903). Until it confirms stopping of the car 12 and receipt of the command to commence learning from the controlling apparatus 5, it continues to transmit to the controlling apparatus 5 repeatedly that learning has not been completed.

When stopping of the car 12 and receipt of the command to commence learning from the controlling apparatus 5 is confirmed, the safety monitoring apparatus 6 commences measurement of the distance moved by the car 12 using the signal from the speed governor encoder 20 (STEP 904).

Next, the safety monitoring apparatus 6 checks whether or not the car 12 has stopped (STEP 905). Then, if the car 12 has stopped, it checks whether or not the uppermost floor switch 25 was opened (STEP 906).

The distance moved by the car 12 at the time of detection of the floor position plates 22 and number of times floor position plates 22 have been detected that is related thereto are stored, and the distance moved by the car 12 at the time of detection of ID information and the ID information that is related thereto are stored, and the distance moved by the car 12 at the time of opening of the uppermost floor switch 25 is also stored by the computational processing in STEPS 909 through 914 until it is detected that the car 12 has stopped and detected that the uppermost floor switch 25 has opened.

When it is detected that the car 12 has stopped and detected that the uppermost floor switch 25 has opened, the distance to the detected position and the number of detections for each of the floor position plates 22 until opening of the uppermost floor switch 25 are related and stored by subtracting the distance moved by the car 12 at the time of detection of each of the floor position plates 22 from the distance moved by the car 12 at the time of the uppermost floor switch 25 opening (STEP 907).

Next, the distance to the detected position and the ID information for each of the ID information until opening of the uppermost floor switch 25 are related and stored by subtracting the distance moved by the car 12 at the time of detection of each of the ID information from the distance moved by the car 12 at the time of the uppermost floor switch 25 opening (STEP 908).

Figure 6:
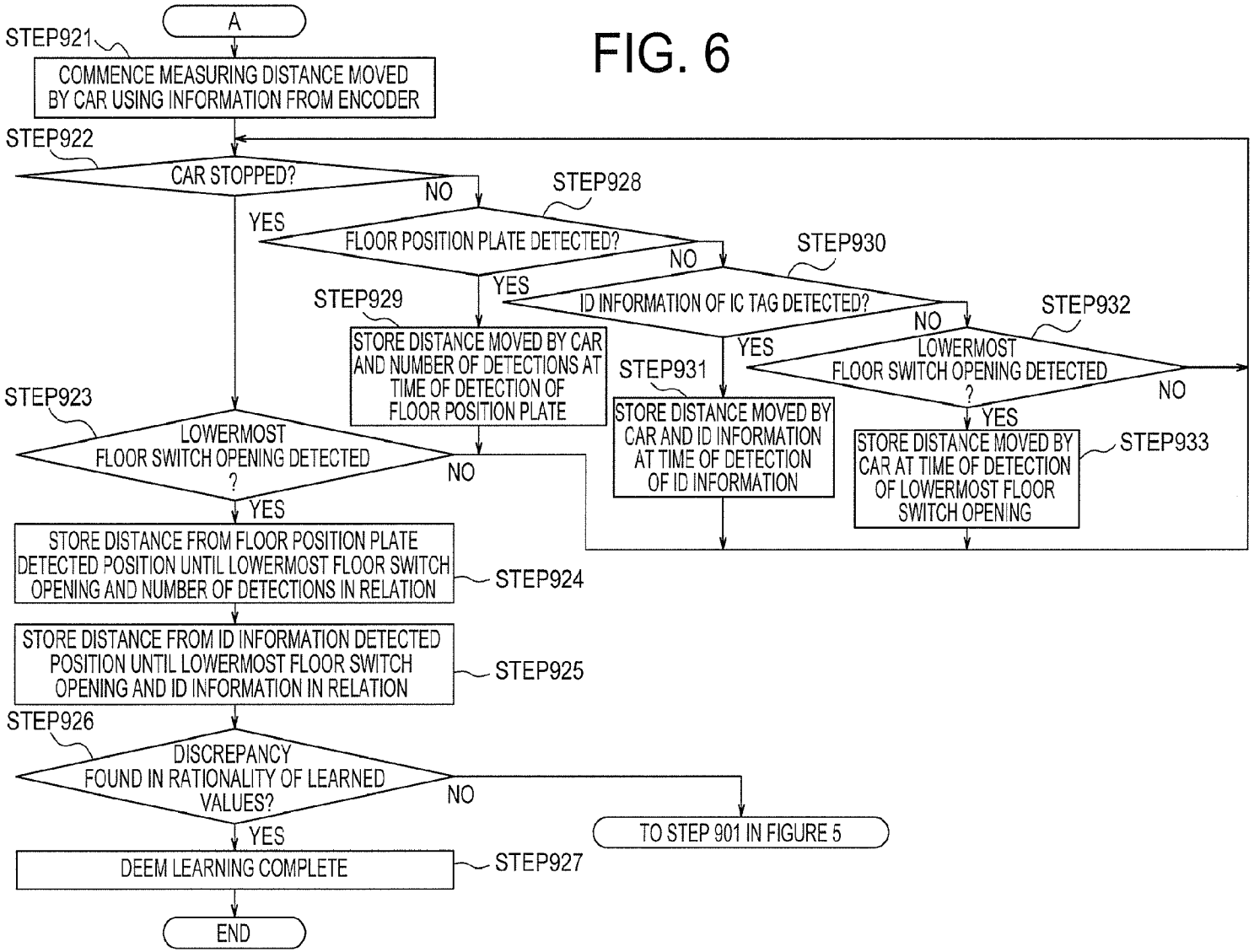
FIG. 6 is a flowchart that shows a second half of detailed operation of STEP 9 in FIG. 3.

FIG. 6 is a flowchart that shows a second half of detailed operation of STEP 9 in FIG. 3. When the controlling apparatus 5 moves the car 12 to the uppermost floor, the car 12 is then moved to the lowermost floor at a sufficiently low velocity. The safety monitoring apparatus 6 once again commences measurement of the distance moved by the car 12 using the signal from the speed governor encoder 20 (STEP 921).

Next, the safety monitoring apparatus 6 checks whether or not the car 12 has stopped (STEP 922). Then, if the car 12 has stopped, it checks whether or not the lowermost floor switch 26 was opened (STEP 923).

The distance moved by the car 12 at the time of detection of the floor position plates 22 and number of times floor position plates 22 have been detected that is related thereto are stored, and the distance moved by the car 12 at the time of detection of ID information and the ID information that is related thereto are stored, and the distance moved by the car 12 at the time of opening of the lowermost floor switch 26 is also stored by the computational processing in STEPS 928 through 933 until it is detected that the car 12 has stopped and detected that the lowermost floor switch 26 has opened.

When it is detected that the car 12 has stopped and detected that the lowermost floor switch 26 has opened, the distance to the detected position and the number of detections for each of the floor position plates 22 until opening of the lowermost floor switch 26 are related and stored by subtracting the distance moved by the car 12 at the time of detection of each of the floor position plates 22 from the distance moved by the car 12 at the time of the lowermost floor switch 26 opening (STEP 924).

Next, the distance to the detected position and the ID information for each of the ID information until opening of the lowermost floor switch 26 are related and stored by subtracting the distance moved by the car 12 at the time of detection of each of the ID information from the distance moved by the car 12 at the time of the lowermost floor switch 26 opening (STEP 925).

Next, the safety monitoring apparatus 6 compares the results of learning during the ascent of the car 12 and the results of learning during the descent, and checks for the presence or absence of discrepancies (STEP 926). If a discrepancy is found here, then STEP 901 in FIG. 5 is returned to, and the computational processing of learning is recommenced. If it is determined that there is no discrepancy, learning is deemed to be completed (STEP 927), and the computational processing for learning (STEP 9 in FIG. 3) is completed.

In an elevator apparatus of this kind, because the uppermost floor switch 25 and the lowermost floor switch 26 have a construction of limit switch, and detected positions of each of the floor position plates 22 and each of the IC tags 21 are learned in advance as distances to the operating points of the uppermost floor switch 25 and the lowermost floor switch 26, it is possible to prevent an unsafe overspeed monitoring level V1 from being set due to failure of the uppermost floor switch 25 or the lowermost floor switch 26. Furthermore, manufacturing of a long cam is not required, and problems with collision noise do not arise. In other words, the position of the car 12 can be detected by a simple configuration, enabling reliability of position detection of the car 12 to be improved.

Furthermore, by adding the forced-separation switches, which are easy to acquire, the car 12 approaching the terminal floors can be detected without delay.

In addition, because the uppermost floor switch 25 and the lowermost floor switch 26 are installed in the hoistway 1, and the switching rail 27 is disposed on the car 12, and the uppermost floor switch 25 and the lowermost floor switch 26 are opened directly by the operation of the car 12, operational reliability of the uppermost floor switch 25 and the lowermost floor switch 26 can be easily ensured.

Furthermore, because the safety monitoring apparatus 6 performs computational processing that stores the distances moved by the car 12 from the positions at which the IC tags 21 are detected to a position at which the uppermost floor switch 25 or the lowermost floor switch 26 opens as detected position information, it is not necessary to install the IC tags 21 accurately in predetermined positions, enabling the time that is required for installation work to be shortened.

Because the IC tags 21 are used as detected bodies, and the IC tag reader 23 is used as a detected body detector, and the safety monitoring apparatus 6 stores the ID information and the detected position information that is detected by the IC tag reader 23 in relation to each other, the time until the position of the car 12 is detected after a state in which the safety monitoring apparatus 6 cannot detect the position of the car 12 (immediately after a power-up, for example) can be shortened.

In addition, because the floor position plates 22 are used as detected bodies, and the floor sensor 24 is used as a detected body detector, equipment that is used for floor alignment and door opening control can be adopted, enabling car position detection at the high level of floor alignment control without increasing equipment in the hoistway 1.

Furthermore, because the overspeed monitoring level V1, which becomes lower toward a terminal floor in a vicinity of the terminal floor, is set in the safety monitoring apparatus 6, even if there is an error in the detection of opening of the uppermost floor switch 25 or the lowermost floor switch 26 during learning, the overspeed monitoring level V1 will be set closer to the intermediate floor, enabling overspeed traveling of the car 12 entering the terminal portion of the hoistway 1 to be detected early.

Moreover, even higher reliability can be ensured if the speed governor encoder 20, the floor sensor 24, the floor position plates 22, the IC tag reader 23, the IC tags 21, and the safety monitoring apparatus 6, the signal input elements that correspond thereto, and the arithmetic processing portion in the safety monitoring apparatus 6 are each configured in duplicate, and comparative checks of the signals and comparative checks of the computational results are implemented.

Configurations in which a plurality of overspeed monitoring levels that have different magnitudes are set in the safety monitoring apparatus 6, and different commands are output in response to each of the levels (patterns) are also conceivable. Examples of commands that correspond to the respective levels include a command to the controlling apparatus 5 requesting that decelerating control be implemented, and a command to operate emergency safeties (not shown) that are mounted to the car 12, for example. By configuring in this manner, responses that correspond to the degree of overspeed traveling become possible, enabling responses to various elements that are factors in overspeed traveling.

In addition, the IC tags 21 do not absolutely need to be disposed so as to correspond to all of the floors, but when the IC tags 21 are disposed so as to correspond to all of the floors, the time taken for the processing in STEP 7 in FIG. 3 can be shortened.

Embodiment 2

Figure 7:
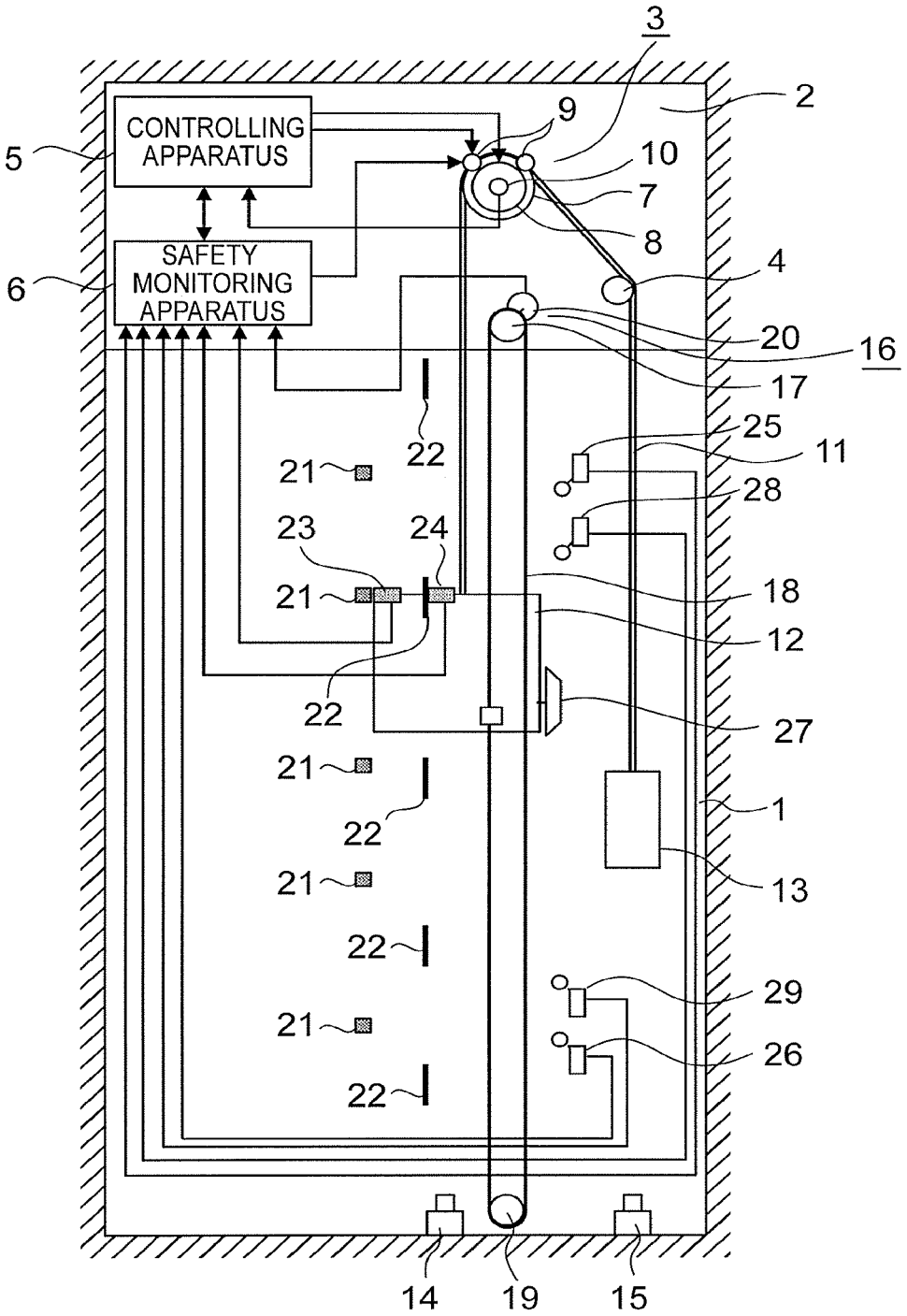
FIG. 7 is a configuration diagram that shows an elevator apparatus according to Embodiment 2 of the present invention.

Next, FIG. 7 is a configuration diagram that shows an elevator apparatus according to Embodiment 2 of the present invention. An upper portion auxiliary switch 28 is disposed in an upper portion inside a hoistway 1 below an uppermost floor switch 25. A lower portion auxiliary switch 29 is disposed in a lower portion inside the hoistway 1 above a lowermost floor switch 26. The upper portion auxiliary switch 28 and the lower portion auxiliary switch 29 are switches that are opened by a switching rail 27 coming into contact therewith.

As the car 12 approaches the uppermost floor, the upper portion auxiliary switch 28 is opened before the uppermost floor switch 25 is opened, and the open state of the upper portion auxiliary switch 28 is maintained until the uppermost floor switch 25 is opened.

As the car 12 approaches the lowermost floor, the lower portion auxiliary switch 29 is opened before the lowermost floor switch 26 is opened, and the open state of the lower portion auxiliary switch 29 is maintained until the lowermost floor switch 26 is opened.

Usually closed switches that have a construction of limit switch (a contact forced-separation mechanism) in which an elastic body is not interposed between a point of contact with the switching rail 27 and the circuit contact are used as the upper portion auxiliary switch 28 and the lower portion auxiliary switch 29.

The upper portion auxiliary switch 28 and the lower portion auxiliary switch 29 are connected to a safety monitoring apparatus 6 by means of wiring. Respective signals from the upper portion auxiliary switch 28 and the lower portion auxiliary switch 29 are inputted into the safety monitoring apparatus 6 thereby. The rest of the configuration is similar or identical to that of Embodiment 1.

Next, details of functioning of the safety monitoring apparatus 6 will be explained. The safety monitoring apparatus 6 implements overspeed travel monitoring of the car 12 using the overspeed monitoring level V1 that is shown in FIG. 2 when the position of the car 12 can be detected, in a similar or identical manner to that of Embodiment 1.

The safety monitoring apparatus 6 continues overspeed travel monitoring of the car 12 even when the position of the car 12 cannot be detected, and performs computational processing for detecting the position of the car 12.

Figure 8:
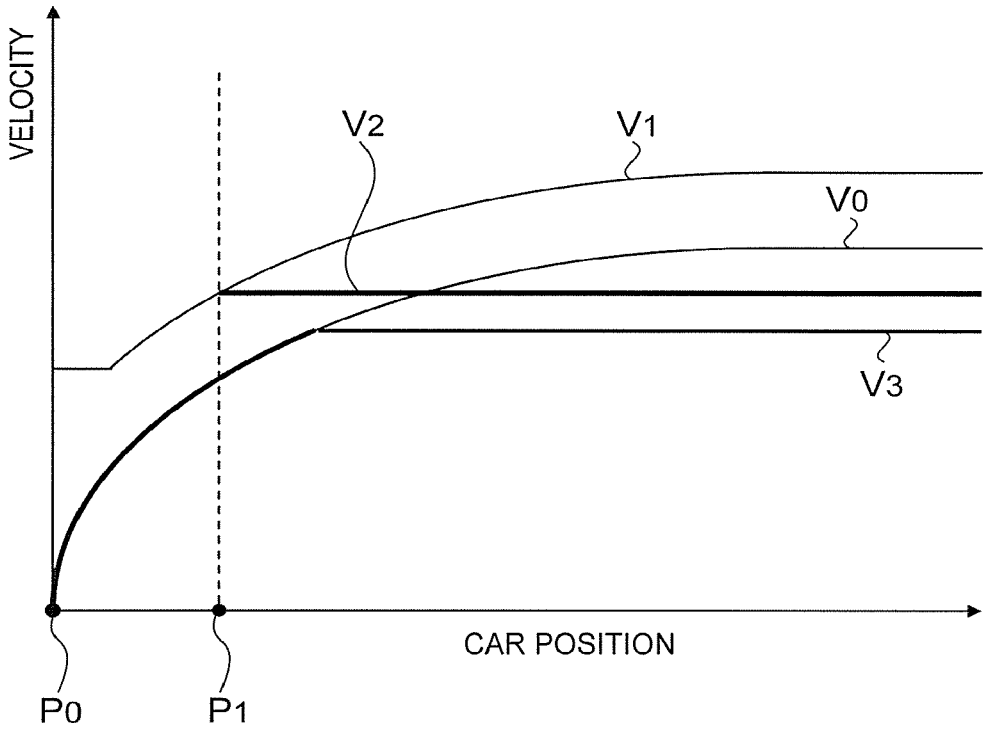
FIG. 8 is a graph that shows overspeed travel monitoring references that are set in a safety monitoring apparatus from FIG. 7.

Overspeed travel monitoring in Embodiment 2 will now be explained using FIG. 8 using the upper portion of the hoistway as an example. In FIG. 8, P0 indicates the position of the car 12 when stopped at the uppermost floor. P1 indicates the position of the car 12 when the car 12 travels toward the uppermost floor, and passes through the position that opens the upper portion auxiliary switch 28. In other words, the upper portion auxiliary switch 28 or the uppermost floor switch 25 is open when the car 12 is closer to the terminal floor than P1 (to the left in FIG. 8), and the upper portion auxiliary switch 28 and the uppermost floor switch 25 are closed when the car 12 is closer to an intermediate floor than P1 (to the right in FIG. 8).

The safety monitoring apparatus 6 can detect that the car 12 is positioned closer to the uppermost floor than the position that opens the upper portion auxiliary switch 28 by detecting that either the upper portion auxiliary switch 28 or the uppermost floor switch 25 is open.

In addition, the safety monitoring apparatus 6 can detect that the car 12 is positioned lower than the position that opens the upper portion auxiliary switch 28 by detecting that the upper portion auxiliary switch 28 and the uppermost floor switch 25 are closed.

Detection of a zone in which the car 12 is positioned in this manner can be implemented immediately after a power-up because it is implemented using only the states of the upper portion auxiliary switch 28 and the uppermost floor switch 25.

An auxiliary monitoring level V2 is set in the safety monitoring apparatus 6 in addition to the overspeed monitoring level V1. The auxiliary monitoring level V2 is set to a constant velocity that is lower than the overspeed monitoring level V1 over an entire region (on the right in FIG. 8) that is closer to the intermediate floor than the position at which the upper portion auxiliary switch 28 is opened. Specifically, the auxiliary monitoring level V2 is set to the velocity of the overspeed monitoring level V1 at P1.

In FIG. 8, a traveling pattern V3 is a locus of a target velocity when the car 12 stops at P0 when the position of the car 12 cannot be detected. The traveling pattern V3 is set so as to be lower than the auxiliary monitoring level V2. In addition, a maximum speed of the traveling pattern V3 is set so as to be lower than a maximum speed of a normal traveling pattern V0.

If it is detected that the car 12 is positioned in a position in which the upper portion auxiliary switch 28 and the uppermost floor switch 25 are closed when the position of the car 12 cannot be detected, then the safety monitoring apparatus 6 implements overspeed travel monitoring that is based on the auxiliary monitoring level V2 over the ascent of the car 12. If opening of the upper portion auxiliary switch 28 is subsequently detected, the position of the car 12 can be detected, and the safety monitoring apparatus 6 commences overspeed travel monitoring that uses the overspeed monitoring level V1.

Although not shown, if it is detected that the car 12 is positioned at the position at which the upper portion auxiliary switch 28 opens when the position of the car 12 cannot be detected, then the overspeed monitoring level for the ascent of the car 12 is set to a minimum value of the overspeed monitoring level V1, or a value that is lower than that, in a similar or identical manner to Embodiment 1, and the safety monitoring apparatus 6 commences overspeed travel monitoring. Moreover, if the car 12 commences ascent from the position at which the upper portion auxiliary switch 28 opens and stops at the uppermost floor, then it is not necessary to limit the traveling velocity any lower than the traveling pattern V3 because it is inconceivable that the velocity of the car 12 would reach the overspeed monitoring level unless an abnormality occurs because the distance traveled is short.

The safety monitoring apparatus 6 also implements overspeed travel monitoring for the descent of the car 12 in a similar manner. In that case, "ascent" above should be replaced with "descent", "uppermost floor switch 25" with "lowermost floor switch 26", and "upper portion auxiliary switch 28" with "lower portion auxiliary switch 29".

Next, the computational processing that the safety monitoring apparatus 6 implements in order to detect the position of the car 12 when the safety monitoring apparatus 6 cannot detect the position of the car 12 will be explained. First, if the safety monitoring apparatus 6 detects that the position of the car 12 could not be ascertained immediately after power-up, etc., then it determines in which region the car 12 is positioned inside the hoistway 1 relative to the uppermost floor and the lowermost floor from the states of the upper portion auxiliary switch 28 and the lower portion auxiliary switch 29.

Next, the safety monitoring apparatus 6 decides the overspeed velocity traveling monitoring reference in response to the region in which the car 12 is positioned, and also transmits information to the controlling apparatus 5 to the effect that the position information for the car 12 cannot be detected. When the controlling apparatus 5 ascertains that the safety monitoring apparatus 6 cannot detect the position of the car 12, service is recommenced so as to limit a maximum value of the traveling velocity of the car 12 to a value that is lower than the auxiliary monitoring level V2.

If the car 12 continues traveling, it will eventually pass the position of installation of an IC tag 21.

In addition to learning by a learning run that is similar or identical to that of Embodiment 1, the safety monitoring apparatus 6 learns in advance by the learning run and stores a distance from the position of the car 12 when the upper portion auxiliary switch 28 opens to the position of the car 12 when the uppermost floor switch 25 opens, and a distance from the position of the car 12 when the lower portion auxiliary switch 29 opens to the position of the car 12 when the lowermost floor switch 26 opens.

If ID information that is embedded in an IC tag 21 is detected, then the safety monitoring apparatus 6 determines which floor position plate 22 is the closest floor position plate 22 in the direction of travel of the car 12, in a similar or identical manner to Embodiment 1. Next, when a floor position plate 22 is detected, the position of the car 12 is determined based on the positions of the floor position plates 22 detected while learning.

Once the safety monitoring apparatus 6 has determined the position of the car 12, the overspeed travel monitoring reference is changed from the auxiliary monitoring level V2 to the overspeed monitoring level V1, and overspeed travel monitoring is continued. The safety monitoring apparatus 6 simultaneously stops transmitting the signal to the controlling apparatus 5 that indicates that the position information of the car 12 cannot be ascertained. The controlling apparatus 5 thereby releases the above-mentioned velocity limitation, and recommences service in which the velocity is raised to the rated velocity.

Next, details of the learning run in Embodiment 2 will be explained. In Embodiment 2, the safety monitoring apparatus 6 implements overspeed travel monitoring that uses the auxiliary monitoring level V2 during the learning run. The controlling apparatus 5 limits the maximum value of the traveling velocity of the car 12 to a lower value than the auxiliary monitoring level V2 during the learning run. Furthermore, the safety monitoring apparatus 6 also learns and stores the detected position information for the upper portion auxiliary switch 28 and the lower portion auxiliary switch 29 during the learning run, in addition to the detected position information and the number of detections for the floor position plates 22, and the detected position information and the ID information for the IC tags 21. The rest of the learning method is similar or identical to that of Embodiment 1.

In an elevator apparatus of this kind, because the upper portion auxiliary switch 28 is disposed closer to the intermediate floor than the uppermost floor switch 25, and the lower portion auxiliary switch 29 is disposed closer to the intermediate floor than the lowermost floor switch 26, and the auxiliary monitoring level V2 that is used when the position of the car 12 cannot be detected is set in the safety monitoring apparatus 6, the overspeed velocity traveling monitoring reference can be set higher than in Embodiment 1 if the safety monitoring apparatus 6 cannot detect the position of the car 12, enabling the traveling velocity also to be set higher. Thus, the time required before the safety monitoring apparatus 6 detects the position of the car 12 is shortened compared to Embodiment 1, enabling serviceability to be improved. Alternatively, the number of IC tags 21 installed can be reduced without losing serviceability, enabling cost reductions and installation savings to be achieved.

Moreover, the uppermost floor switch 25 and the lowermost floor switch 26 may be installed exclusively for learning of the detected position information, or may be used also as switches that are installed for other purposes.

The reference position switches are not limited to forced-separation switches, provided that they are opened reliably when the car 12 moves to the terminal floor.

In addition, in the above examples, the uppermost floor and the lowermost floor are made reference positions, but the reference positions do not absolutely need to be aligned with the uppermost floor and the lowermost floor, and reference positions can also be set closer to the termini than the uppermost floor and the lowermost floor, for example.

Furthermore, a reference position switch may alternatively be disposed in only one of the upper and lower portions of the hoistway 1.

The storage media that are used as the detected bodies are not limited to the IC tags 21, and may be tags to which a bar code is applied, for example.

In addition, the detected bodies are not limited to the storage media and the floor position plates 22, and consequently the detected body detectors are not limited to the IC tag reader 23 and the floor sensor 24.

Furthermore, the detected bodies are not limited to a particular number.

The movement detector is also not limited to an encoder.

In addition, in the above examples, the safety monitoring apparatus 6, which implements overspeed travel monitoring, is presented as the car position detecting portion, but the car position detecting portion is not limited thereto, and may be a safety monitoring apparatus that monitors for the presence or absence of an abnormality other than overspeed traveling, or a controlling apparatus that implements control of the elevator apparatus using the detected position information, for example.

Furthermore, the overall layout of the elevator apparatus is not limited to that in FIGS. 1 and 7. For example, the present invention can also be applied to elevator apparatuses that use two-to-one (2:1) roping methods, elevator apparatuses in which a hoisting machine is installed in a lower portion of a hoistway, etc.

In addition, the present invention can be applied to any type of elevator apparatus, such as machine-roomless elevators, linear motor elevators, hydraulic elevators, double-deck elevators, single-shaft multi-car elevators in which a plurality of cars are disposed inside a shared hoistway, etc.

The invention claimed is:

1. An elevator apparatus comprising:

a car that is raised and lowered inside a hoistway;

a reference position switch that detects that the car is positioned at a reference position in a vicinity of a terminus of the hoistway;

at least one detected body that is installed inside the hoistway;

a detected body detector that is disposed on the car for detecting the detected body when the car passes a position of installation of the detected body, and for transmitting detected position information for the detected body;

a movement detector that outputs a signal that corresponds to an amount of movement of the car; and a car safety monitor that detects a position of the car inside the hoistway, wherein:

the reference position switch is a usually closed switch that is opened by the car moving to the reference position; and the car safety monitor receives and stores as the detected position information for the detected body an amount of movement of the car from where the detected body is detected by the detected body detector until the car is detected by the reference position switch by a learning run that is implemented in advance, and after completion of the learning run, detects the position of the car based on information from the detected body detector, the stored detected position information, and information from the movement detector.

2. The elevator apparatus according to claim 1, wherein:

a switch operating member that comes into contact with the reference position switch to open the reference position switch is disposed on the car; and the reference position switch is installed in the hoistway, and has a construction of limit switch in which an elastic body is not interposed between a point of contact with the switch operating member and a circuit contact.

3. The elevator apparatus according to claim 1, wherein:

the detected body includes a storage medium in which specific identifying information is stored;

the detected body detector includes a reader that reads the identifying information from the storage medium; and the car safety monitor stores the detected position information and the identifying information in relation to each other.

4. The elevator apparatus according to claim 1, wherein:

two or more of the detected bodies are installed inside the hoistway;

the detected bodies include floor position plates that each show a floor alignment position for the car;

the detected body detector includes a floor sensor that detects the floor position plates; and the car safety monitor stores a number of detections of the floor position plate from a position at which the floor position plate is detected by the floor sensor until the car is detected by the reference position switch in relation to the detected position information.

5. The elevator apparatus according to claim 1, wherein the car safety monitor detects when the car approaches a terminal floor.

6. The elevator apparatus according to claim 5, wherein:

an overspeed monitoring level that becomes lower toward the terminal floor in a vicinity of the terminal floor is set in the car safety monitor; and the car safety monitor implements overspeed travel monitoring of the car by comparing a velocity of the car with the overspeed monitoring level.

7. The elevator apparatus according to claim 6, wherein:

an auxiliary monitoring level that is that is less than or equal to the overspeed monitoring level in all parts of the hoistway is set in the car safety monitor; and the car safety monitor detects overspeed traveling of the car in a state in which a position of the car cannot be detected by comparing a velocity of the car with the auxiliary monitoring level.

8. The elevator apparatus according to claim 7, wherein:

an auxiliary switch is disposed closer to an intermediate floor than the reference position switch inside the hoistway; and the auxiliary monitoring level is set to a constant velocity that is lower than the overspeed monitoring level closer to the intermediate floor than a position at which the auxiliary switch is operated.

9. The elevator apparatus according to claim 8, wherein the auxiliary monitoring level is set to a velocity that is equal to the overspeed monitoring level at a position at which the auxiliary switch is operated when closer to the intermediate floor than a position at which the auxiliary switch is operated.

* * * * *